US005586779A

United States Patent [19]

Dawes et al.

[11] Patent Number: 5,586,779

[45] Date of Patent: Dec. 24, 1996

[54] ADJUSTABLE SNOWBOARD BOOT BINDING APPARATUS

[76] Inventors: Paul J. Dawes, 12422 Skyline Blvd., Woodside, Calif. 94062; Thomas A. Krulevitch, 2833 Kensington Rd., Redwood City, Calif. 94061; Peter A. Krulevitch, 4319 Railroad Ave. #19, Pleasanton, Calif. 94566

[21] Appl. No.: 466,989

[22] Filed: Jun. 6, 1995

[51] Int. Cl.[6] ..... A63C 5/00; A63C 9/00

[52] U.S. Cl. ..... 280/14.2; 280/607; 280/613; 280/618

[58] Field of Search ..... 280/607, 613, 280/617, 618, 620, 626, 629, 636, 633, 14.2; 441/70

[56] References Cited

U.S. PATENT DOCUMENTS

| | | | |
|---|---|---|---|
| 2,955,300 | 10/1960 | Hedlund et al. | 280/618 |
| 3,511,516 | 5/1970 | Smolka et al. | 280/636 |
| 3,672,695 | 6/1972 | Baukhage | 280/620 |
| 4,964,649 | 10/1990 | Chamberlin | 280/618 |
| 5,028,068 | 7/1991 | Donovan | 260/618 |
| 5,044,654 | 9/1991 | Meyer | 280/618 |
| 5,054,807 | 10/1991 | Fauvet | 280/633 |
| 5,188,386 | 2/1993 | Schweizer | 280/607 |
| 5,236,216 | 8/1993 | Ratzek | 280/607 |
| 5,261,689 | 11/1993 | Carpenter et al. | 280/618 |
| 5,277,635 | 1/1994 | Gillis | 441/74 |
| 5,344,179 | 9/1994 | Fritschi | 280/618 |
| 5,354,088 | 10/1994 | Vetter | 280/618 |

FOREIGN PATENT DOCUMENTS

| | | | |
|---|---|---|---|
| 0432588 | 6/1991 | European Pat. Off. | 280/607 |
| 677191 | 4/1991 | Switzerland . | |
| 8908480 | 9/1989 | WIPO | 280/633 |
| 9209339 | 6/1992 | WIPO | 280/607 |

*Primary Examiner*—Kevin Hurley
*Assistant Examiner*—Min Yu
*Attorney, Agent, or Firm*—John J. Penny, V

[57] ABSTRACT

A snowboard boot binding device comprising a binding mount plate for fixedly mounting a snowboard binding thereto, said binding mount plate having a cavity centrally defined therein, a ring fixedly attached to said binding mount plate having a bore centrally defined therethrough, a hub for mounting said boot binding device to a snowboard, said hub being centrally disposed in said cavity and extending through said bore, wherein said binding mount plate is free to rotate about said hub, thereby allowing for adjustment of an angular position of said binding mount plate, and locking means for arresting and releasing rotation of said binding mount plate, thereby allowing the angular position of said binding mount plate to be adjusted.

4 Claims, 8 Drawing Sheets

ADJUSTABLE SNOWBOARD BOOT BINDING APPARATUS

BACKGROUND OF THE INVENTION

1. Field of the Invention

This invention relates generally to boot bindings for snowboards and more particularly to a snowboard boot binding apparatus which allows the angular position of the snowboard boot binding relative to the snowboard to be quickly and easily adjusted without removing the snowboard boot from the binding.

2. Description of Prior Art

Snowboarding is a recreational sport, similar to skiing, wherein a person travels down an inclined snow-covered surface while mounted to a board similar to a skateboard or surfboard. The popularity of snowboarding is rapidly growing all over the world and may soon surpass skiing. As a result of this growth, the quality of snowboards, snowboard bindings and associated peripheral equipment has improved significantly over the years.

As on a skateboard or surfboard, a snowboard rider stands so that both feet are positioned at an angle substantially perpendicular to the longitudinal axis of the snowboard (the direction of travel). This position is desirable because it allows the snowboarder to roll back and forth on their heels and balls of their feet in order to change the surface impression of the board in the snow, thus enabling the snowboard to turn. In order to maintain this position, the protective boots worn by a snowboarder are mounted to a binding which is fixedly bolted to the top surface of the snowboard at the desired angular position.

A snowboard rider often wants to adjust the angular position of their feet relative to the longitudinal axis of the snowboard to accommodate different snow conditions or snowboarding styles (i.e. slalom racing, downhill cruising or freestyle acrobatics). This is difficult to do with the above described conventional snowboard binding system, since the angle can only be adjusted by unbolting and repositioning the whole binding, which is a cumbersome and time-consuming procedure.

Also, it is extremely difficult for a snowboarder to propel themselves across flat surfaces using the conventional snowboard boot binding system. Traditionally, when snowboarders encounter surfaces which require external propulsion, they release their back foot from the rear binding and propel themselves by pushing with the released back foot while the front foot continues to be strapped into the front binding. In order to more effectively propel themselves in this manner, the snowboarders typically rotate their upper body and hips so that their shoulders are perpendicular to the direction of travel and their back foot is parallel to (i.e. pointed in) the direction of travel. This makes it easier to "push-off" with the back foot. However, because the front foot is positioned almost perpendicular to the direction of the travel, a great deal of torque is induced on the front knee. Further, it is difficult to maintain the shoulders and hips in this position. This awkward positioning makes it extremely difficult for a snowboarder to propel themselves across flat surfaces using the conventional snowboard boot binding system. Because the terrain in the vicinity of ski lifts is generally substantially flat, these problems are encountered every time a snowboarder rides a ski lift.

Also, the conventional snowboard boot binding system presents problems while riding chair lifts. Snowboarders typically board the chair lift with the same binding configuration used while propelling themselves, that is, with the front foot mounted in the binding and the back foot released. On a typical chair lift, the riders sit side by side facing the direction of travel of the chair lift. Therefore, the front foot of the snowboarder points in this direction as the snowboarder sits on the chair lift. Since the front foot is still mounted to the binding, the snowboard extends at an angle substantially perpendicular to the direction of travel of the chair lift, thus interfering with the skis or snowboards of other riders. This is especially problematic when the snowboarder sits in the middle of a 4-person chair lift (quad chair lift). It is possible for the snowboarder to alleviate this problem by rotating their front foot in order to point the board straight ahead. However, this induces torque on the knee and is extremely uncomfortable for the snowboarder, especially if they assume this position for an extended period time, for example during a long chair lift.

Devices have been developed which allow a snowboarder to adjust the rotational orientation of the binding. For example, U.S. Pat. No. 5,028,068 (Donovan) teaches a device for rotatably mounting a snow-boot binding to a snowboard. As shown in FIGS. 2 and 3, this device comprises a support plate 25 to which a conventional boot binding 11 is mounted. Support plate 25 is fixedly mounted to swivel plate 31 using nuts 28. Swivel plate 31 is pivotally mounted to an adapter plate 29 via center bearing 33. A flexible cable 57 passes around the circumference of the swivel plate through a groove 53. The rotation of swivel plate is released and arrested by tightening and loosening a manually operated handle 51 as shown in FIG. 3. To adjust the angular orientation of the binding relative to the snowboard, the user releases the handle 51, rotates the swivel plate to the desired position and then re-locks the handle.

Although the device of Donovan allows for the rotational adjustment of the snowboard binding, it suffers from several drawbacks. since the rotational position of the swivel plate 31 is only secured by the friction between the flexible cable 57 and swivel plate 34, an external force, such as one exerted by the snowboarder while snowboarding, may force the swivel plate to rotate. The presence of ice or snow in the vicinity of the cable 57 may exacerbate this problem by reducing the friction between the cable 57 and swivel plate 34. Since the handle is on the surface of the snowboard, the handle may become disengaged from the locked position during operation of the snowboard by a piece of snow or ice. Also, the device taught by Donovan is large and heavy. Further, there is a large gap between the bottom of the snowboard boot and the top of the snowboard.

U.S. Pat. No. 5,277,635 (Gillis) teaches a water skiboard binding system which allows for the rotational adjustment of the bindings relative to the direction of travel of the skiboard. The rotational position of the binding is adjusted by rotating footbed 136 about baseplate 110 to the desired rotational position. The rotational position of the baseplate 110 is secured by wire 146 which is locked and unlocked via handle 158. Because a wire is used to secure the position of the baseplate 110, this system suffers from the same problems as the device taught by Donovan.

U.S. Pat. No. 5,261,698 (Carpenter) teaches a snowboard binding system whose rotational position relative to an axis perpendicular to the snowboard can be adjusted. The binding system comprises a binding plate 18 which can be rotated relative to a hold-down plate 30 which is fixed to the snowboard 10 via screws (not shown) extending through holes 42 in the hold-down plate. The binding plate 18 and the hold-down plate 30 each have ribs or ridges 34 and 32, respectively, which lock the angular position of the binding plate relative to the hold-down plate. The rotational position of the binding plate 18 can only be adjusted by removing the snowboard boot from the binding plate 18 and disengaging the screws from the holes 42 in the hold-down plate. Therefore, angular adjustment of the binding cannot be done "on the fly".

SUMMARY OF THE INVENTION

It is therefore an object of the present invention to provide a snowboard boot binding apparatus which enables a snowboarder to quickly and easily adjust the angular position of the snowboard binding without removing the snowboard boot from the binding.

It is another object of the invention to provide an adjustable snowboard boot binding apparatus which effectively maintains the desired angular position.

It is another object of the invention to provide an adjustable snowboard boot binding apparatus which is compatible with existing snowboard boot bindings and snowboards. This allows different binding/board combinations to be used without requiring new holes to be drilled in the board.

It is another object of the invention to provide an adjustable snowboard boot binding apparatus which is easy and inexpensive to manufacture.

It is another object of the invention to provide a thin and light snowboard boot binding apparatus.

It is another object of the invention to provide a snowboard boot binding apparatus which prevents snow and ice from interfering with the proper functioning of the device.

The snowboard boot binding device of the present invention comprises a binding mount plate for fixedly mounting a snowboard binding thereto, said binding mount plate having a cavity centrally defined therein, a ring fixedly attached to said binding mount plate having a bore centrally defined therethrough, a hub for mounting said boot binding device to a snowboard, said hub being centrally disposed in said cavity and extending through said bore, wherein said binding mount plate is free to rotate about said hub, thereby allowing for adjustment of an angular position of said binding mount plate, and locking means for arresting and releasing rotation of said binding mount plate, thereby allowing the angular position of said binding mount plate to be adjusted.

DETAILED DESCRIPTION OF THE PREFERRED EMBODIMENTS

Figure 1:
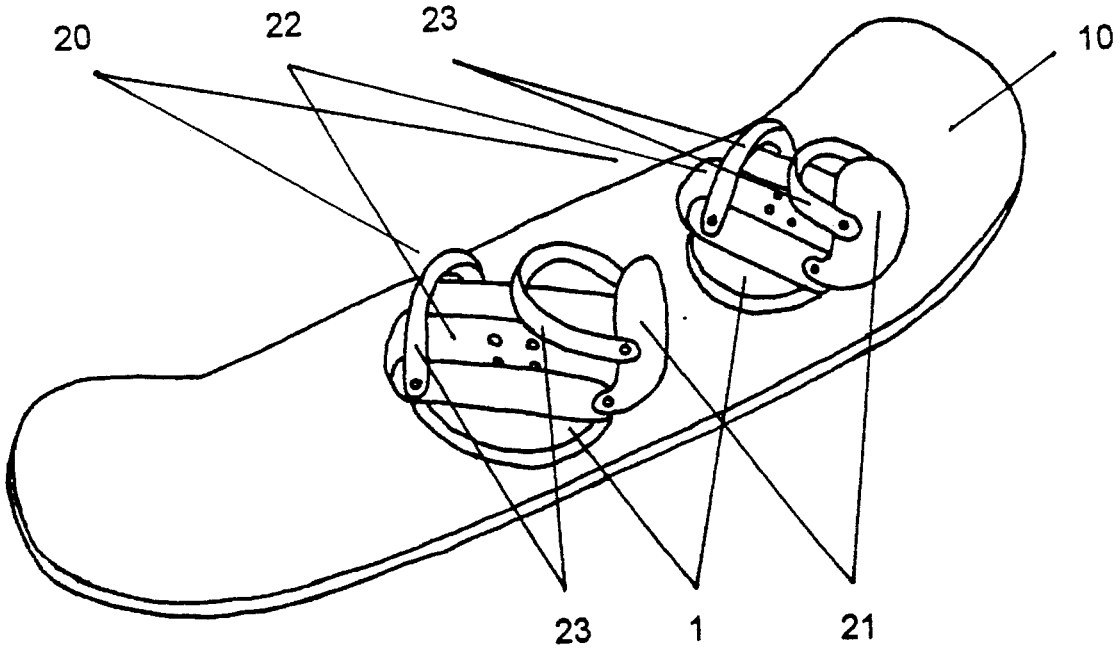
FIG. 1 shows the present invention mounted to a snowboard.

FIG. 1 shows generally the boot binding apparatus 1 of the present invention, mounted to snowboard 10. A conventional snowboard binding 20 is mounted to the boot binding apparatus 1. Binding 20 comprises a snow boot holding member 21 made of plastic, metal or any other suitable material for holding the snow board boot (not shown) in the binding 20. The snow boot holding member 21 is fixedly mounted to a binding plate 22. Straps 23 are used to attach the snow board boot to the binding plate 22.

Figure 2:
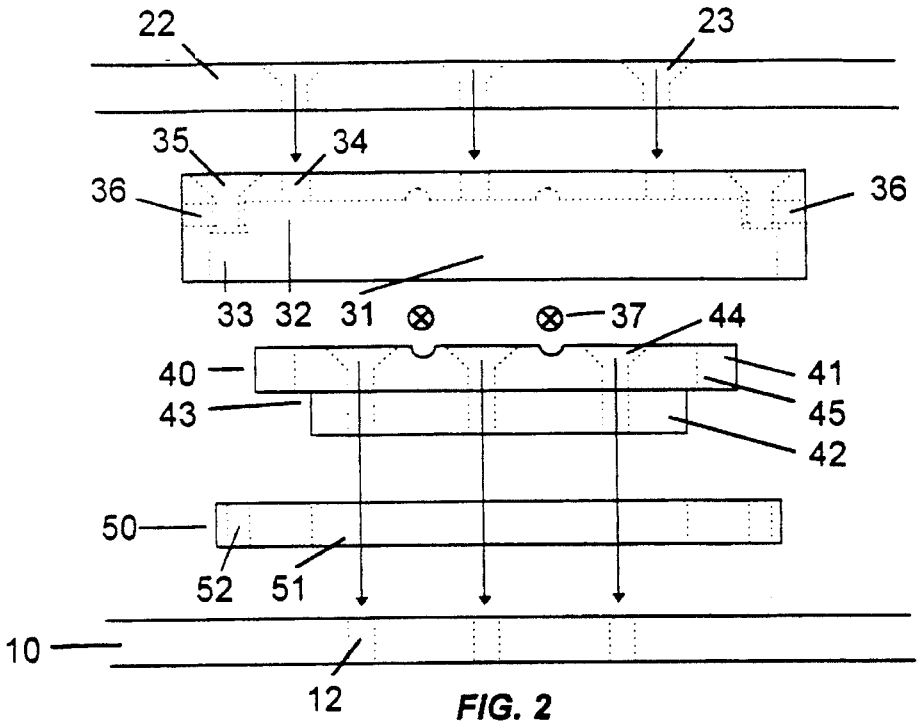
FIG. 2 shows an exploded side view of a first embodiment of the present invention.

As shown in FIG. 2, a first embodiment of the boot binding apparatus 1 of the present invention comprises a circular binding mount plate 30 having a cavity 31 centrally defined therein. The cavity 31 comprises an upper section 32 and a lower section 33, wherein the diameter of the lower section 33 is larger than the diameter of the upper section 32. Binding plate 22 is fixedly mounted to the binding mount plate 30 via screws, bolts or any other suitable fastener (not shown) which extend through screw holes 23 in binding plate 22 and screw holes 34 in binding mount plate 30. The boot binding apparatus 1 also comprises circular hub 40 having a top section 41 and a bottom section 42. The diameter of the bottom section 42 is loss than the diameter of the top section 41, thereby forming shoulder 43.

The boot binding apparatus 1 also comprises ring 50 having a central bore 51. The diameter of the bore 51 is approximately equal to the diameter of the bottom section 42 of the hub 40. The diameter of the ring 50 is approximately equal to the diameter of the lower section 33 of the cavity 31. The bottom section 42 of the hub 40 is inserted into the bore 51 of the ring 50 so that the shoulder 43 rests on the ring 50. Then the hub 40 is fixedly mounted to the snowboard with screws, bolts or any other suitable fastener (not shown) which extends through screw holes 44 in the hub and screw holes 12 in the snowboard. In this resulting configuration, the ring 50 is free to rotate about the bottom section 42 of the hub 40 about an axis perpendicular to the surface of the snowboard 10.

The binding mount plate 30 is placed over the hub 40 so that the top section 41 of the hub 40 fits into the top section 32 of the cavity 31 of the binding mount plate 30 and the ring 50 fits into the bottom section 33 of the cavity 31. When the binding mount plate 30 is placed over the hub in this manner, the screw holes 52 of the ring 50 are in axial alignment with screw holes 35 of the binding mount plate 30. The binding mount plate 30 is then attached to the ring 50 with screws, bolts or any other suitable fastener (not shown) which extend through screw holes 35 and screw holes 52. In this resulting configuration, the combined binding mount plate 30 and ring 50 is free to rotate about the hub 40 which is fixedly attached to the snowboard 10. A bearing 37 is disposed between the binding mount plate 30 and the hub 40 to assist in the rotation of the binding mount plate 30.

Figure 3:
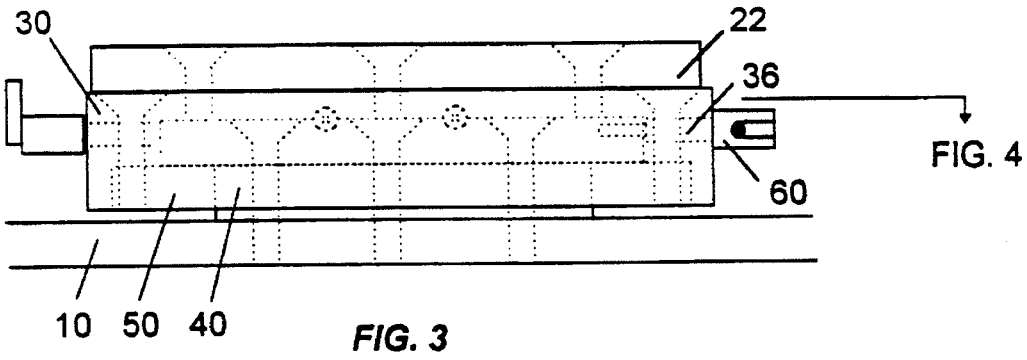
FIG. 3 shows a side assembled view of the embodiment shown in FIG. 2.

To complete the boot binding apparatus 1, the binding plate 22 is fixedly mounted to the binding mount plate 30 with screws, bolts or any other suitable fastener (not shown) which extend through screw holes 23 in binding plate 22 and screw holes 34 in binding mount plate 30. In this resulting configuration, which is shown in FIG. 3, the binding plate 22 is free to rotate about the hub 40 about an axis perpendicular to the surface of the snowboard 10, thereby making it possible to adjust the angular position of the snowboard binding about this axis. Also, the boot binding apparatus is substantially sealed, thereby preventing the entry of ice and snow.

Figure 4A:
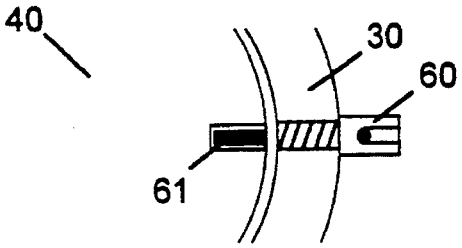
FIGS. 4A and 4B show a partial view of the lock mechanism of the embodiment of FIGS. 2 and 3 in the locked and unlocked position, respectively.
Figure 4B:
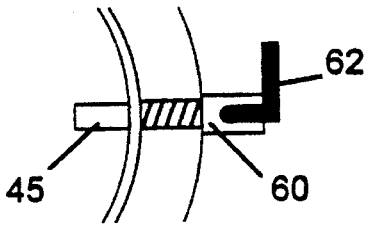

The rotational position of the binding plate 22 is arrested and released via a lock mechanism 60, which is fixed to the side of the binding mount plate 30 as shown in FIG. 3. Although FIG. 3 shows two lock mechanisms 60 for the binding plate 22, one lock mechanism may be sufficient. The lock mechanism 60 is screwed into the threaded hole 36 in the binding mount plate 30. The lock mechanism 60 consists of a centrally disposed spring loaded plunger 61. As shown in FIG. 4, the plunger 61 extends through the binding mount plate 30 and into the hub 40 when the lock mechanism is in the locked position. A handle 62 is used to lock and unlock the plunger 61. The hub 40 has a plurality of slots 45 radially disposed about the circumference of the hub 40 for receiving the plunger 61 when it is in the locked position, thereby allowing for the fine rotational adjustment of the binding mount plate. As shown in FIGS. 2–4, the slots 45 are machined into the entire thickness of the top portion 41 of the hub 40. Holes bored into the top portion 41 of the hub 40 could also be used for the slots 45. The snowboarder selects the desired rotational position of the snowboard binding by releasing the handles 62 of the lock mechanisms 60 and rotating the binding plate 22 while the snow board boot is still attached to the snowboard. When the desired angular position is reached, the snowboarder releases the handle 62 and rotates the binding plate 22 until the plunger "clicks" into one of the plurality of slots 45. An off-the-shelf retractable spring loaded plunger "Vlier full travel hand retractable spring plunger P/N SSFR-250" was found to be effective.

Finer adjustment of the boot binding apparatus can be attained by providing gear teeth on the hub 40 and utilizing a plunger adapted to mesh with the gear teeth of the hub 40 in the locked position.

A bearing can be used to facilitate the rotation of the ring/binding mount plate about the hub, although this is not necessary for proper operation of the device.

The binding mount plate is not required if its functionality is integrated into the snowboard binding.

Figure 5A:
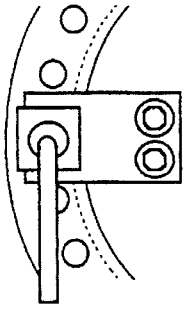
FIG. 5A and 5B show a side view and top view of a second embodiment of the present invention.
Figure 5B:
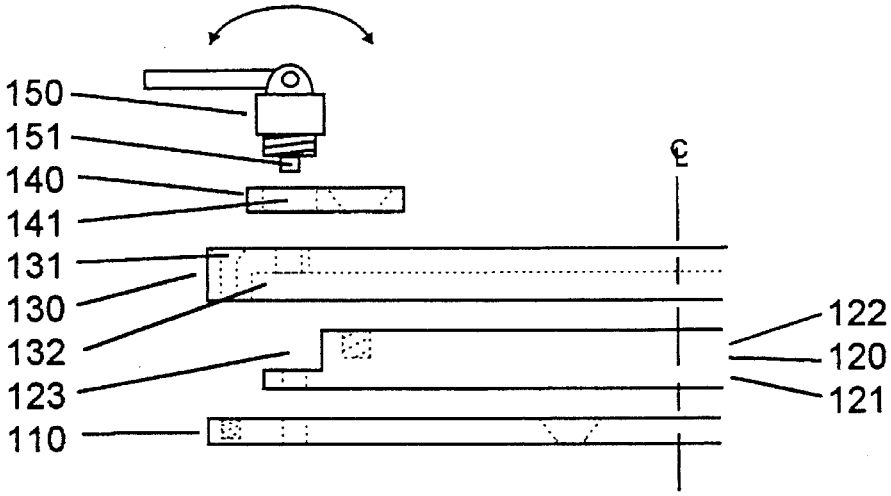
Figure 6:
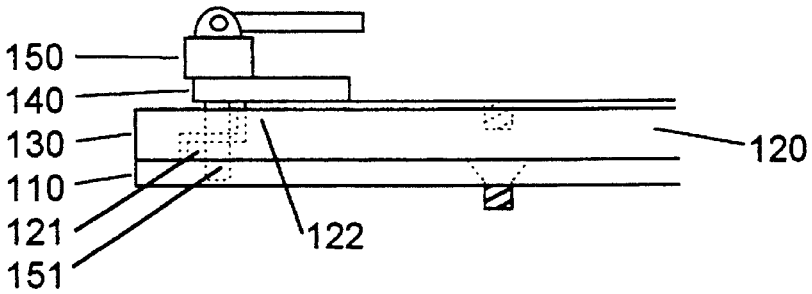
FIG. 6 shows the second embodiment as assembled.
Figure 7:
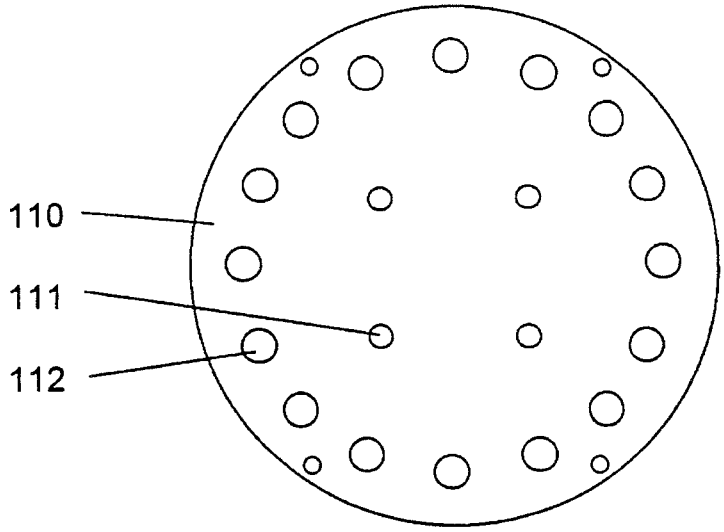
FIG. 7 shows the board mount plate 110 of FIGS. 5A, 5B and 6.
Figure 8:
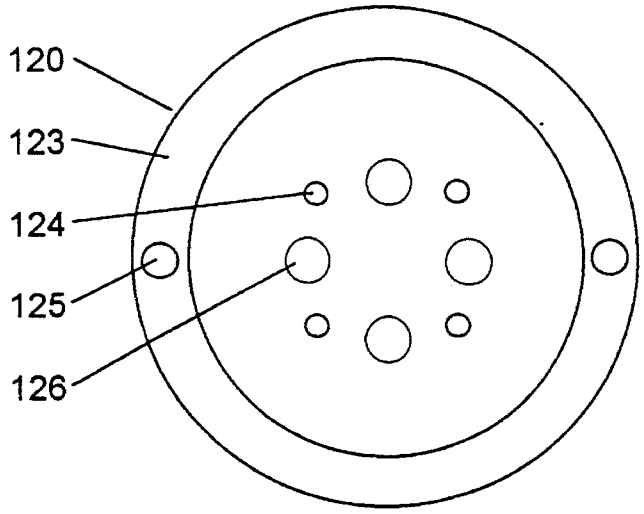
FIG. 8 shows the binding mount plate 120 of FIGS. 5A, 5B and 6.

FIG. 5A and 5B show a second embodiment of the present invention. FIG. 6 shows the second embodiment as assembled. A circular board mount plate 110, shown separately in FIG. 7, is fixedly mounted to snowboard 10 with screws, bolts or any other suitable fasteners (not shown) which extend through screw holes 111 of board mount plate 110 into snowboard 10. The board mount plate 110 has a plurality of circumferentially disposed holes 112. A circular binding mount plate 120 rests on board mount plate 110. As shown in FIG. 6, binding mount plate 120 comprises a lower section 121 and an upper section 122. The diameter of lower section 121 is greater than upper section 122, thereby forming a shoulder 123. As shown in FIG. 8, the binding mount plate 120 also comprises two holes 125 oppositely disposed at an outer radial position. Large holes 126 provide access to screws in board mount plate 110 for removal of the device from the snowboard.

Figure 9:
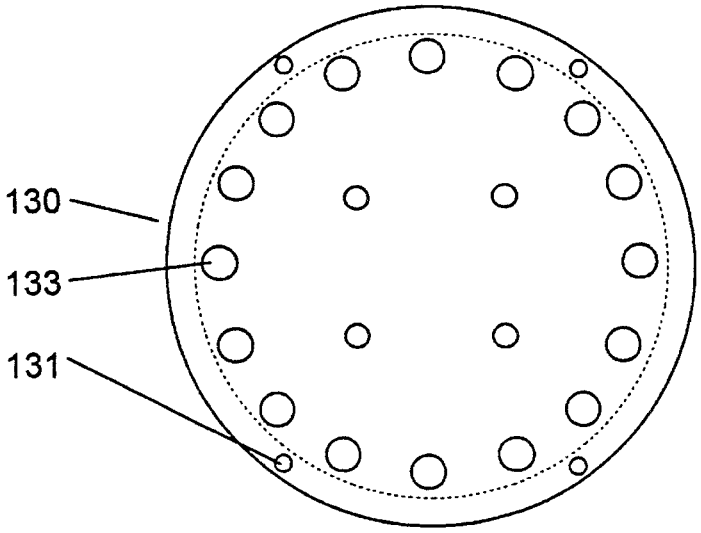
FIG. 9 shows the ring 130 of FIGS. 5A, 5B and 6.

A circular ring 130 is fixedly mounted to the board mount plate 110 with screws, bolts or any other suitable fasteners (not shown) which extend through screw holes 131 (see FIG. 9) of ring 130 and one of the plurality of holes 112 of board mount plate 110. The ring 130 has an L-shaped cross-section, thereby forming a cavity 132 for receiving the shoulder 123 of the binding mount plate 120. With the shoulder 123 disposed in the cavity 132, the binding mount plate 120 is free to rotate about an axis perpendicular to the snowboard 10. The ring 130 has a plurality circumferentially disposed holes 133.

Plunger clamp mount 140 is fixedly mounted to binding mount plate 120 with screws, bolts or any other suitable fastener (not shown) as shown in FIG. 6. A plunger clamp 150 is fixedly attached to the plunger clamp mount 140 through hole 141 as shown in FIG. 6.

Next, the operation of the boot binding apparatus of the second embodiment of the present invention will be described. The snowboard binding is attached to the binding mount plate 120 with screws, bolts or any other suitable fastener (not shown) which extend through mount holes 124 (see FIG. 8). As described above, the binding mount plate is free to rotate about an axis perpendicular to the snowboard 10, thereby allowing the snowboard user to adjust the angular position of the bindings. The rotation of the binding mount plate 120 is released and arrested with the plunger clamp 150. When the plunger clamp 150 is in the locked position, the plunger 151 extends through the plunger clamp mount 140, one of the plurality of holes 133 in the ring 130, one of the two holes 125 of binding mount plate 120 corresponding to the plunger clamp 150, and one of the plurality of holes 122 in the board mount plate 110, thereby locking the rotational position of the binding mount plate 120. When the plunger clamp 150 is in the unlocked position, the plunger 151 is retracted from the holes 141, 133, 125, and 112, thereby allowing the snowboard user to adjust the angular rotation of the snowboard boot binding. It has been found that the plunger clamp Carr Lane P/N CL-150-TPC with the plunger travel cut to an appropriate length is satisfactory.

Figure 10A:
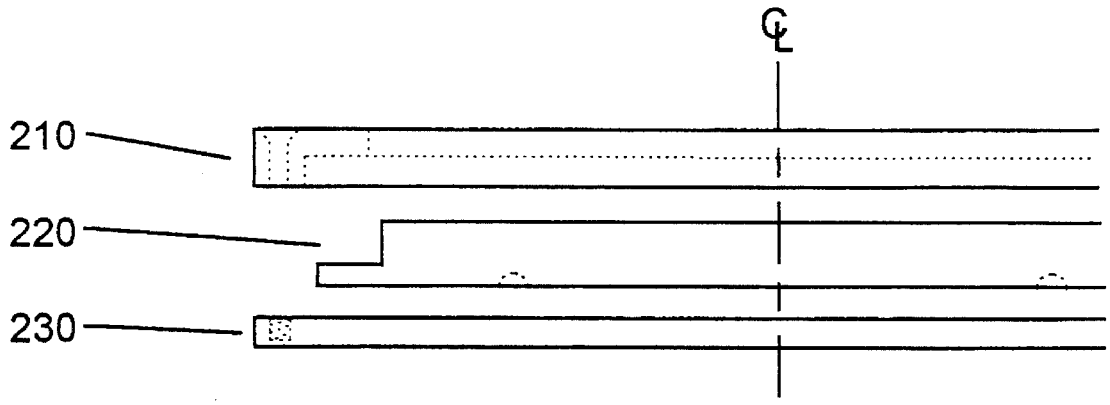
FIGS. 10A and 10B show a third embodiment of the present invention.
Figure 10B:
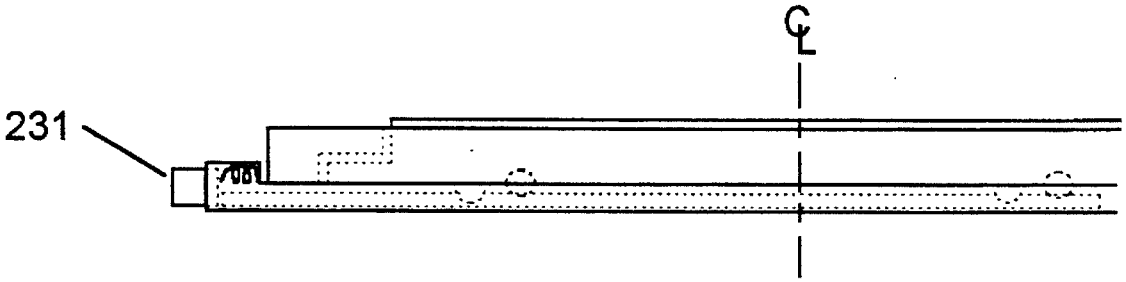

FIGS. 10A and 10B show a third embodiment of the present invention, a snowboard boot binding rotation device with bottom lock balls. The device shown in FIG. 10A is symmetric about the center line. Disk 220 is confined between ring 210 and disk 230. In the locked position, pin 231 is in an out position and the lock balls are pushed into Disk 220, thereby securing disk 220. When pin D is pushed in, the lock balls are pushed into cups in pin 231 by the rotation of disk 220 (or the lock balls simply drop into the cups) and disk 220 is free to rotate.

Figure 11A:
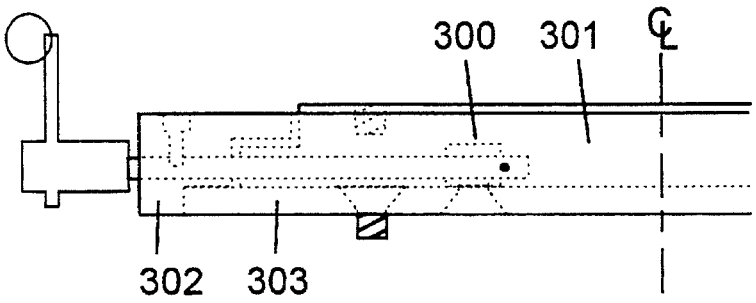
FIGS. 11A–11C show a fourth embodiment of the present invention.
Figure 11B:
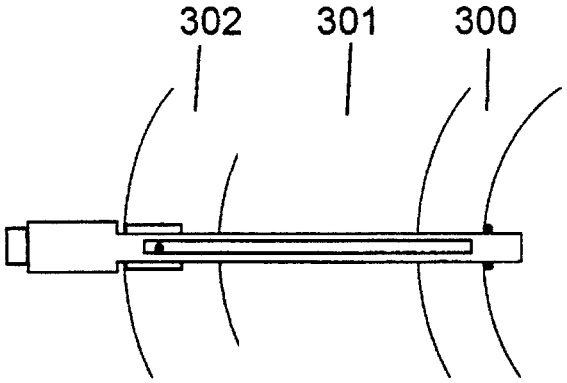
Figure 11C:
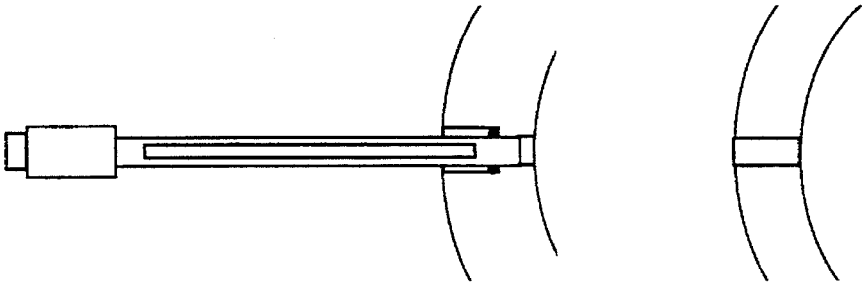

FIGS. 11A–11C show a fourth embodiment of the present invention. Disk 301 rotates on top of disk 303 and is constrained between ring 302 and disk 303. One or two single acting ball lock pins prevent disk 301 from rotating by constraining disk 301 between ring 302 and ring 303.

The snowboard binding attaches to disk 301, and the disk 303 attaches to the snowboard. FIG. 11B shows a top view in the locked position. FIG. 11C shows a top view in the unlocked position wherein disk 301 is free to rotate.

Figure 12A:
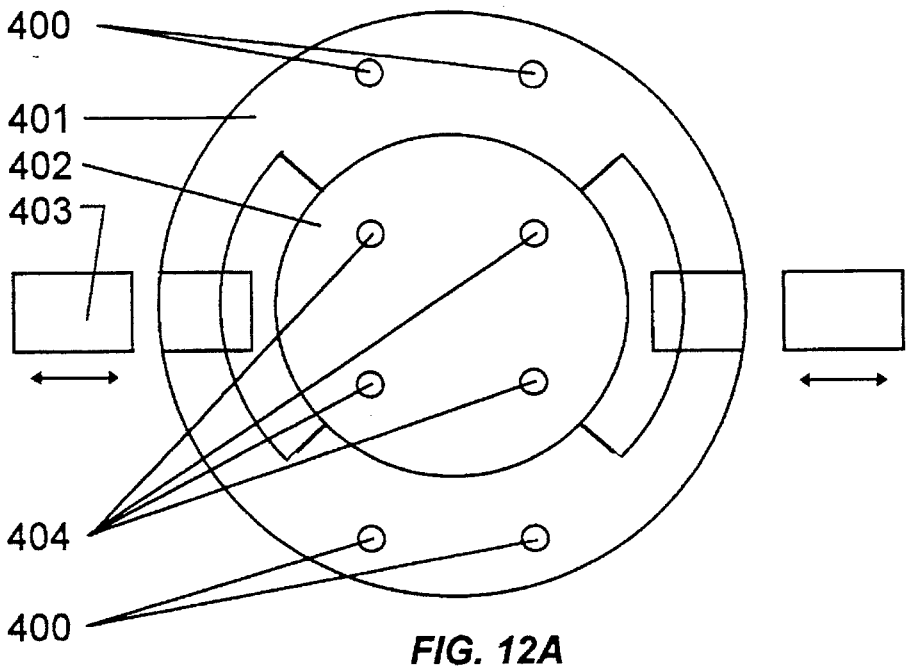
FIGS. 12A–12C show a fifth embodiment of the present invention.
Figure 12B:
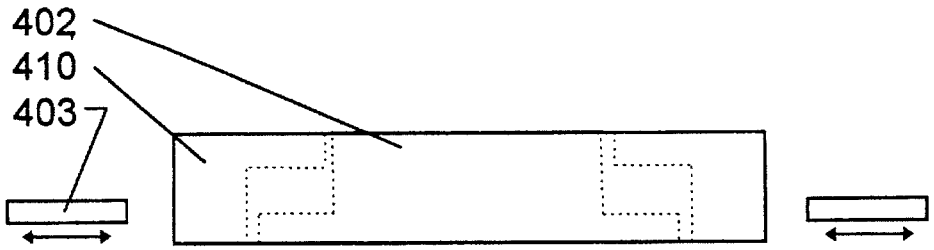
Figure 12C:
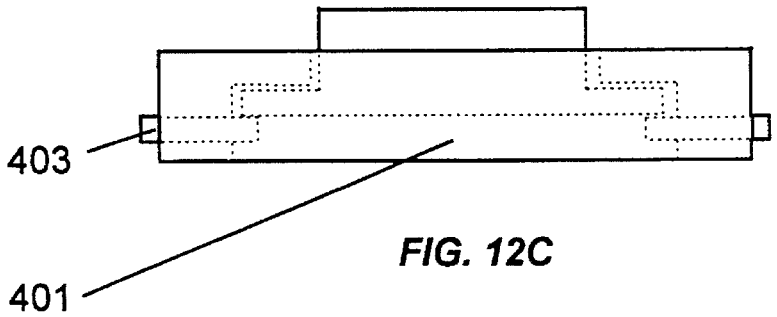

FIGS. 12A–12C show a fifth embodiment of the present invention, a snowboard binding rotation device with lift and unlock plate. In a locked position, plate 402 is secured from rotating by disk 401 and secured from lifting by the locks in the "in" position. In a rotating position, the locks are pulled out, plate 402 is lifted, and the locks are returned to the "in" position. Plate 402 is now free to rotate between ring 410 and the locks.

FIG 12B shows the plate 402 in a down position with the locks 404 in the unlocked position. FIG. 12C shows the plate 402 in the up position with the locks 404 in the locked position. The snowboard device of the fifth embodiment attaches to a snowboard through holes 400 and the snowboard binding attached to the device through holes 404.

Figure 13A:
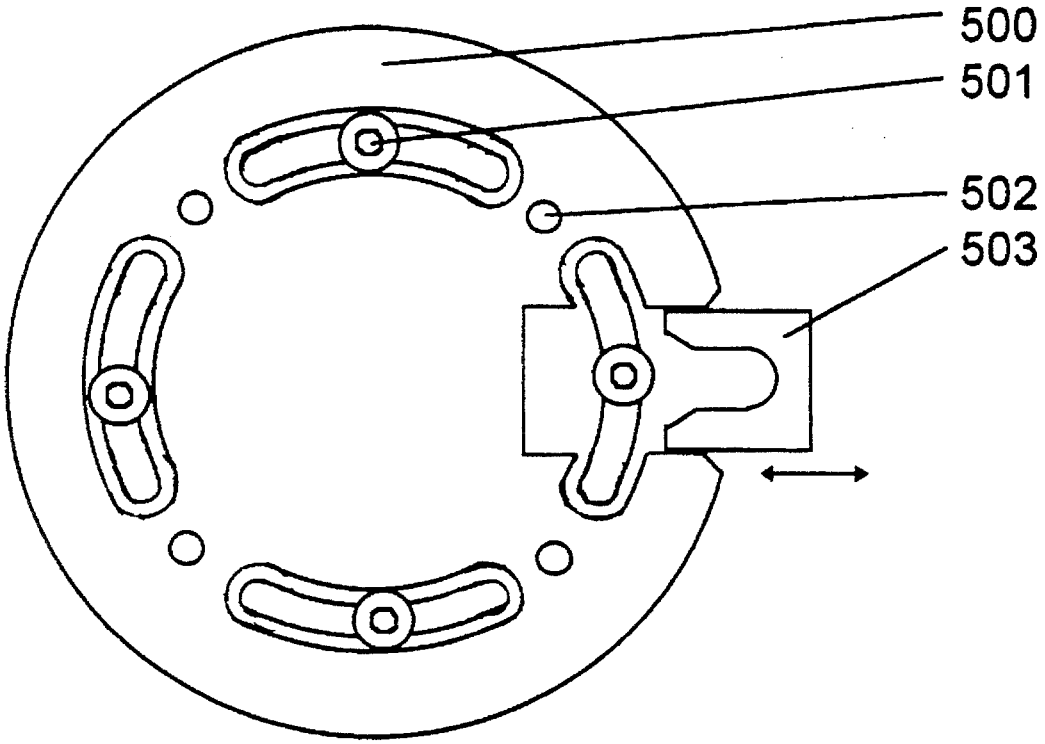
FIGS. 13A and 13B show a sixth embodiment of the present invention.
Figure 13B:
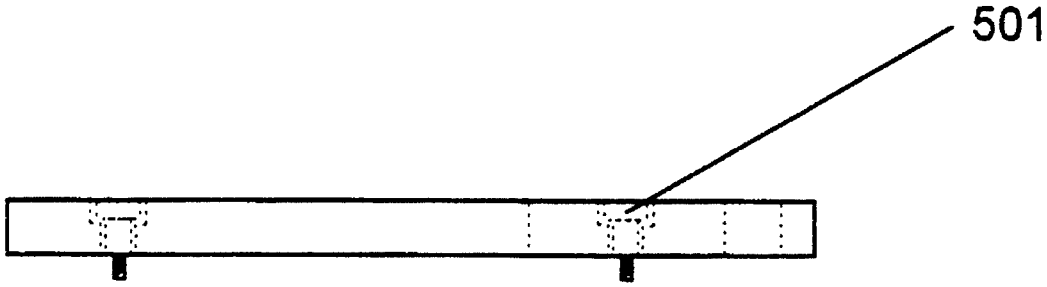

FIGS. 13A and 13B show a sixth embodiment of the present invention, a snowboard binding rotation device with a shoulder bolt board attachment and a "U" shaped lock 503. Disk 500 is attached to snowboard with 2–4 shoulder bolts 501. A "U" shaped lock in the "in" position prevents Disk 500 from rotating and the "U" shaped lock in the "out" position permits 45–90 degree rotation.

The device of FIG. 13A attaches to a snowboard by bolts 501, and a snowboard binding is attached to the device through holes 502.

The components of all embodiments can be made of machined aluminum, machined plastic or injection molded plastic. Plastic parts would have metal inserts to strengthen holes.

Various changes and modifications could be made to the embodiments herein described without departing from the scope of the invention.

What is claimed is:

1. A snowboard boot binding device comprising:

a binding mount plate for fixedly mounting a snowboard binding thereto, said binding mount plate having a cavity centrally defined therein;

a ring fixedly attached to said binding mount plate, said ring having a bore centrally defined therethrough;

a hub for mounting said boot binding device to a snowboard, said hub being centrally disposed in said cavity and extending through said bore, wherein said binding mount plate and said ring rotate about said hub, thereby allowing for adjustment of an angular position of said binding mount plate, said ring dimensioned to hold said binding mount plate to said hub; and said binding mount plate to be adjusted.

2. The snowboard boot binding device of claim 1, further including a bearing disposed between said binding mount plate and said hub for assisting in the rotation of said binding mount plate.

3. The snowboard boot binding device of claim 1 wherein said locking means is a spring loaded retractable plunger.

4. A snowboard boot binding device comprising:

a binding mount plate for fixedly mounting a snowboard binding thereto, said binding mount plate having a cavity centrally defined therein;

a ring fixedly attached to said binding mount plate having a bore centrally defined therethrough;

a hub for mounting said boot binding device to a snowboard, said hub being centrally disposed in said cavity and extending through said bore, wherein said binding mount plate and said ring rotate about said hub, thereby allowing for adjustment of an angular position of said binding mount plate; and locking means for arresting and releasing rotation of said binding mount plate, thereby allowing the angular position of said binding mount plate to be adjusted, wherein:

said hub comprises a plurality of radially disposed slots for receiving said locking means and a top section having a first diameter and a bottom section having a second diameter, wherein said second diameter is less than said first diameter, thereby forming a shoulder;

said bore has a diameter approximately equal to said second diameter; and said cavity comprises an upper cavity having a diameter approximately equal to said first diameter and a lower cavity having a diameter approximately equal to a diameter of said ring.

* * * * *